United States Patent [19]

Weder

[11] Patent Number: 5,038,933

[45] Date of Patent: Aug. 13, 1991

[54] WRAPPING MATERIAL FOR PROVIDING A DECORATIVE COVERING

[75] Inventor: Donald E. Weder, Highland, Ill.

[73] Assignee: Highland Supply Corporation, Highland, Ill.

[21] Appl. No.: 360,367

[22] Filed: Jun. 2, 1989

[51] Int. Cl.[5] ..... B65D 85/50; B65D 85/52; A01G 9/02

[52] U.S. Cl. ..... 206/423; 47/72; 206/813

[58] Field of Search ..... 206/813, 820, 423; 47/72

[56] References Cited

U.S. PATENT DOCUMENTS

| | | | |
|---|---|---|---|
| 239,987 | 4/1981 | Shellenberger . | |
| 254,659 | 4/1981 | Karotseris | D11/143 |
| 292,562 | 11/1987 | Weder et al. | D11/164 |
| 292,563 | 11/1987 | Weder et al. | D11/164 |
| 293,224 | 12/1987 | Weder et al. | D11/164 |
| 293,774 | 1/1988 | Weder et al. | D11/164 |
| 293,775 | 1/1988 | Weder et al. | D11/164 |
| 716,668 | 12/1902 | Cheney . | |
| 732,889 | 7/1903 | Paver . | |
| 923,663 | 6/1909 | Kroeger . | |
| 1,002,346 | 9/1911 | Weeks . | |
| 1,052,379 | 2/1913 | Ranken . | |
| 1,069,675 | 8/1913 | Claussen . | |
| 1,206,708 | 11/1916 | Hutchins . | |
| 1,421,027 | 6/1922 | Reynolds . | |
| 1,421,628 | 7/1922 | Watkins . | |
| 1,446,563 | 2/1923 | Hughes . | |
| 1,693,435 | 11/1928 | Clarke . | |
| 1,863,216 | 6/1932 | Wordingham . | |
| 1,868,853 | 7/1932 | Sievers . | |
| 1,920,533 | 8/1933 | Strauss | 281/34 |
| 1,924,926 | 8/1933 | Gray | 65/53 |
| 1,951,642 | 3/1934 | Augustin et al. | 47/34 |
| 1,978,631 | 10/1934 | Herrlinger | 91/68 |
| 1,979,771 | 11/1934 | Potter | 47/41 |
| 1,994,962 | 3/1935 | Rushfeldt | 206/423 |
| 2,049,030 | 7/1936 | Strauss | 206/820 X |
| 2,076,212 | 4/1937 | Suter et al. | 91/67.9 |
| 2,123,075 | 7/1938 | Langa | 47/34 |
| 2,152,648 | 4/1939 | Jones | 47/34 |
| 2,278,673 | 4/1942 | Savada et al. | 154/43 |
| 2,302,259 | 11/1942 | Rothfuss | 41/10 |
| 2,355,559 | 8/1944 | Renner | 229/8 |
| 2,373,634 | 4/1945 | Wagner | 206/813 X |
| 2,411,328 | 11/1946 | Macnab | 33/12 |
| 2,482,981 | 9/1949 | Kamrass | 41/13 |
| 2,510,120 | 6/1950 | Leander | 117/122 |
| 2,529,060 | 11/1950 | Trillich | 117/68.5 |
| 2,774,187 | 12/1956 | Smithers | 47/41 |
| 2,822,287 | 2/1958 | Avery | 117/14 |
| 2,827,217 | 3/1958 | Clement | 229/1.5 |
| 2,845,735 | 8/1958 | Werner | 41/10 |
| 2,942,823 | 6/1960 | Chapman | 248/97 |
| 2,967,652 | 1/1961 | Canfield | 229/5.5 |
| 3,013,689 | 12/1961 | Shropshire | 215/100.5 |

(List continued on next page.)

FOREIGN PATENT DOCUMENTS 163453 12/1985 European Pat. Off. .

(List continued on next page.)

OTHER PUBLICATIONS

Exhibit A. Curtis Wagner Co., Inc., Houston, TX, shows thick, stiff shiny red plastic pot cover with large scalloped border. (Photograph).

(List continued on next page.)

*Primary Examiner*—William I. Price

*Attorney, Agent, or Firm*—Dunlap, Codding, Peterson & Lee

[57] ABSTRACT

A wrapping material for providing a decorative covering for an item wherein the wrapping material has a width and at least a first end. The first end of the wrapping material is positioned on the outer peripheral surface of the item to be wrapped and the wrapping material is wrapped about the outer peripheral surface of the item while moving the wrapping material generally over the outer peripheral surface of the item until the wrapping material covers at least a portion of the outer peripheral surface of the item.

5 Claims, 5 Drawing Sheets

U.S. PATENT DOCUMENTS

| | | | |
|---|---|---|---|
| 3,022,605 | 2/1962 | Reynolds | 47/58 |
| 3,094,810 | 6/1963 | Kalpin | 47/37 |
| 3,130,113 | 4/1964 | Silman | 161/97 |
| 3,271,922 | 9/1966 | Wallerstein et al. | 53/3 |
| 3,376,666 | 4/1968 | Leonard | 47/11 |
| 3,488,022 | 1/1970 | Vittori | 248/152 |
| 3,552,059 | 1/1971 | Moore | 47/41.12 |
| 3,554,434 | 1/1971 | Anderson | 229/55 |
| 3,620,366 | 11/1971 | Parkinson | 206/59 C |
| 3,681,105 | 8/1972 | Milutin et al. | 117/15 |
| 3,775,903 | 12/1973 | Pike | 47/37 |
| 3,869,828 | 3/1975 | Matsumoto | 47/34.11 |
| 3,962,503 | 6/1976 | Crawford | 428/40 |
| 3,974,960 | 8/1976 | Mitchell | 229/62 |
| 4,043,077 | 8/1977 | Stonehocker | 47/66 |
| 4,054,697 | 10/1977 | Reed et al. | 428/40 |
| 4,118,890 | 10/1978 | Shore | 47/28 R |
| 4,170,618 | 10/1979 | Adams | 264/101 |
| 4,216,620 | 8/1980 | Weder et al. | 47/72 |
| 4,250,664 | 2/1981 | Remke | 47/76 |
| 4,283,032 | 8/1981 | Smith | 248/97 |
| 4,297,811 | 11/1981 | Weder | 47/72 |
| 4,300,312 | 11/1981 | Weder et al. | 47/72 |
| 4,338,979 | 7/1982 | Dow | 141/10 |
| 4,340,146 | 7/1982 | Stratton | 215/100.5 |
| 4,380,564 | 4/1983 | Cancio et al. | 428/167 |
| 4,400,910 | 8/1983 | Koudstaal et al. | 47/84 |
| 4,413,725 | 11/1983 | Bruno et al. | 206/45.33 |
| 4,488,697 | 12/1984 | Garvey | 248/101 |
| 4,508,223 | 4/1985 | Catrambone | 206/423 |
| 4,621,733 | 11/1986 | Harris | 206/423 |
| 4,717,262 | 1/1988 | Roen et al. | 383/120 |
| 4,733,521 | 3/1988 | Weder et al. | 53/580 |
| 4,773,182 | 9/1988 | Weder et al. | 47/72 |
| 4,795,601 | 1/1989 | Cheng | 264/138 |
| 4,835,834 | 6/1989 | Weder et al. | 29/525 |

FOREIGN PATENT DOCUMENTS

| | | | |
|---|---|---|---|
| 2948265 | 5/1981 | Fed. Rep. of Germany . | |
| 2036163 | 12/1970 | France . | |
| 2272914 | 12/1975 | France . | |
| 2489126 | 3/1982 | France . | |
| 8101464 | 10/1982 | Netherlands . | |
| 161005 | 4/1933 | Switzerland . | |
| 274167 | 6/1951 | Switzerland . | |
| 560532 | 4/1972 | Switzerland . | |
| 28130 | 9/1907 | United Kingdom . | |
| 158098 | 1/1921 | United Kingdom | 47/72 |
| 1204647 | 9/1970 | United Kingdom . | |

OTHER PUBLICATIONS

Exhibit B. Jacobson Pot Cover Company of Scranton, PA, advertising literature.

Exhibit C. Photograph of pot cover, manufacturer unknown, but very similar to #C21 on Exhibit B (Jacobson literature).

Exhibit D. Photocopy of photo of pot cover ("Platform Pot Dresser") made by John Raisen Corp., San Francisco, CA.

Exhibit E. Photograph of 2-part pot cover system made by Floral Decor, subsidiary of John Henry Co., Lansing MI.

Exhibit F. Photo of pot cover made by a Holland company (K.P.I.). Date of first public use believed to be late 1984.

Exhibit G. "The Glass of Frederick Carder", copyright 1971 by P. V. Gardner, showing various styles of glass basket-like vases or containers.

Exhibit H. "Speed Cover®" brochure, published in 1983 by Applicants, showing various pot covers for sale.

Exhibit I. "Speed Cover®" brochure, published in 1983 by Applicants, showing various pot covers for sale.

Exhibit J. Item published in 1936 by Gellman Bros., Minneapolis, MN. Shows an assortment of paper hats.

Exhibit K. Photo of various other flower pot wrappings, sold in rolls or sheets and used in the floral industry for years.

Exhibit L. Photo of pot cover made of woven straw--like material.

Exhibit M. Photo of basket-type pot cover used in the floral industry.

Exhibit N. "Speed Cover®" brochure, published in 1984 by Applicants, showing various pot covers for sale.

It is also known to shape a sheet of shape-sustaining wrapping material, such as foil, to a pot using a board with a central hole, the diameter being greater than the diameter of the pot, by pushing the pot through the hole pulling the wrapping through the hole so that the wrapping is gathered around the pot.

WRAPPING MATERIAL FOR PROVIDING A DECORATIVE COVERING

FIELD OF THE INVENTION

The present invention relates to a wrapping material and a method for providing a decorative covering for an item wherein the wrapping material is wrapped about the outer peripheral surface of the item and moved over the outer peripheral surface of the item until at least a portion of the outer peripheral surface of the item is covered by the wrapping material.

DESCRIPTION OF THE PREFERRED EMBODIMENTS

Figure 1:
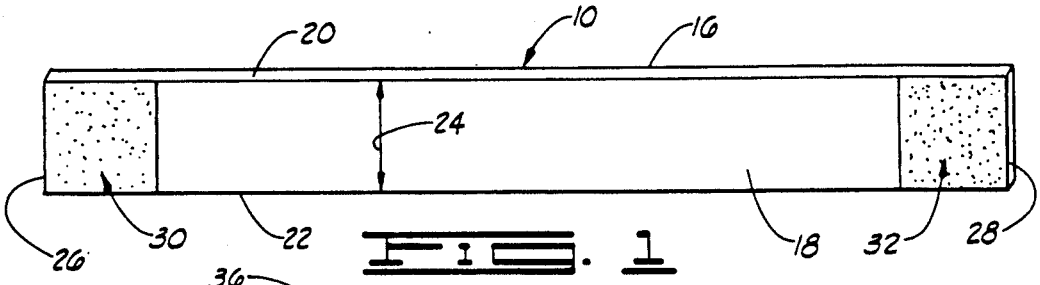
FIG. 1 is a partial perspective view of a wrapping material constructed in accordance with the present invention.

The present invention defines a wrapping material 10 shown in FIG. 1 which is adapted to provide a decorative covering for an item. The wrapping material 10 is adapted to be wrapped about a portion of the item for providing a decorative covering for the item. The wrapping material 10 is used for gift wrapping an item in one embodiment. In another embodiment, the wrapping material 10 is wrapped about a portion of the outer peripheral surface of a flower pot 12 (FIG. 2) to provide a decorative covering for the flower pot. In another embodiment, the wrapping material 10 is wrapped about a portion of a floral grouping 14 (FIG. 11) to provide a decorative covering for the floral grouping 14 and to provide a means for securing the floral grouping in an assembled position.

The wrapping material 10 has an upper surface 16, a lower surface 18, a first side 20 and a second side 22. The wrapping material 10 has a width 24 which extends generally between the first and the second sides 20 and 22. The wrapping material 10 has a first end 26 and a second end 28.

In one preferred embodiment is shown in FIG. 1, a first strip of adhesive 30 is provided on a portion of the lower surface 18 generally near the first end 26 and the first strip of adhesive 30 extends a distance generally from the first end 26 toward the second end 28. In this embodiment, a second strip of adhesive 32 is provided on a portion of the lower surface 18 generally near the second end 28 of the wrapping material 10. The second strip of adhesive 32 extends a distance generally from the second end 28 toward the first end 26 of the wrapping material 10.

The wrapping material 10 is adapted to be wrapped about a portion of the outer peripheral surface of an item to provide a decorative covering for such item. In one embodiment, the wrapping material 10 is adapted to be wrapped about a portion of the flower pot 12 for providing a decorative covering for the flower pot 12. The wrapping material 10 also is adapted to be wrapped about a portion of an outer peripheral surface formed by a plurality of items for holding the items in a group and providing a decorative covering for such grouping. In this embodiment, the wrapping material 10 is adapted to be wrapped about the floral grouping 14 for holding the floral grouping 14 in a group and for providing a decorative covering for the floral grouping 14.

In one other embodiment, the wrapping material 10 is adapted to be wrapped about at least a portion of the outer peripheral surface formed by an item such as a package 34 which may contain a gift for example. It should be noted that the package 34 also could comprise the gift per se and the wrapping material 10 could be wrapped about the gift per se in lieu of a packaging containing the gift.

The wrapping material 10 is constructed from a material selected from the group materials consisting of cellophane, paper, fabric (synthetic or natural or combinations thereof), foil, man-made organic polymer film, cling wrap, or combinations thereof.

The term "cling wrap" as used herein means any material which is capable of connecting to the sheet of material and/or itself upon contacting engagement during the wrapping process and is wrappable about an item whereby portions of the cling material contactingly engage and connect to other portions of the wrapping material for generally securing the sheet of material wrapped about at least a portion of the item. This connecting engagement is preferably temporary in that the wrapping material may be easily removed without tearing same, i.e., the cling material "clings" to the wrapping material. However, the present invention also contemplates a wrapping material which remains securely connected to and about the wrapped item until the wrapping material is torn therefrom.

Preferably the cling wrap is constructed and treated if necessary, from polyethylene such as Cling Wrap made by Glad ®, First Brands Corporation, Danbury, Conn. The thickness of the cling material will, in part, depend upon the thickness of the sheet of material utilized, i.e., generally, the thicker and therefore heavier sheet of material may require a thicker and therefore stronger cling material. Generally, the cling wrap will range in thickness from less than about 0.5 mil to about 2.5 mil. However, any thickness of cling wrap may be utilized in accordance with the present invention which permits the cling wrap to function as previously described.

The term "man-made organic polymer film" as used herein means a man-made resin such as a polypropylene as opposed to naturally occurring resins such as cellophane. A man-made organic polymer film is relatively strong and not as subject to tearing (substantially nontearable), as might be the case with paper or foil. The man-made organic polymer film is a substantially linearly linked processed organic polymer film and is a synthetic linear chain organic polymer where the carbon atoms are substantially linearly linked. Such films are synthetic polymers formed or synthesized from monomers. Further, a relatively substantially linearly linked processed organic polymer film is virtually waterproof which may be desirable in many applications such as wrapping a floral grouping. Additionally a relatively thin film of substantially linearly linked processed organic polymer does not substantially deteriorate in sunlight. Processed organic polymer films having carbon atoms, both linearly linked and cross linked, and some cross linked polymer films, also may be suitable for use in the present invention provided such films are substantially flexible and can be made in a sheet-like format for wrapping purposes of the present invention.

The term "floral grouping" is used herein means cut fresh flowers, artificial flowers, other fresh and/or artificial plants or other floral materials and may include other secondary plants and/or ornamentation which add to the aesthetics of the overall floral grouping.

Figure 2:
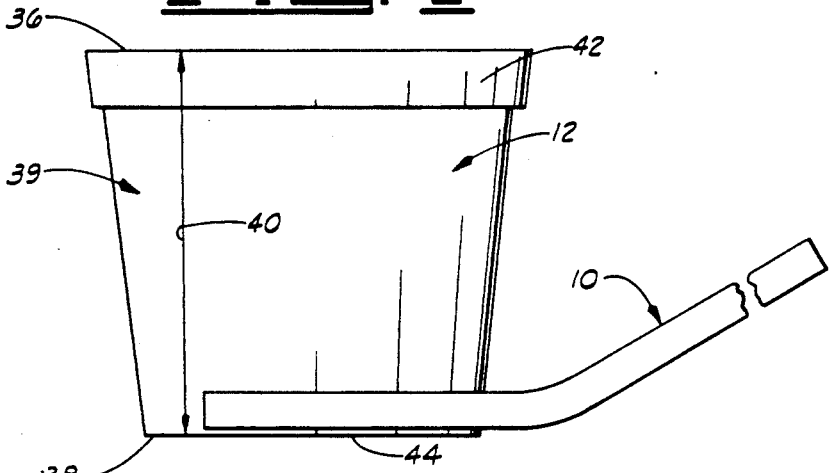
FIG. 2 is a side elevational view of a flower pot showing one end of the wrapping material of FIG. 1 connected to a portion of the outer peripheral surface of the flower pot and the wrapping material extending over a portion of the outer peripheral surface of the flower pot in a starting position for wrapping the wrapping material generally about a portion of the outer peripheral surface of the flower pot.
Figure 3:
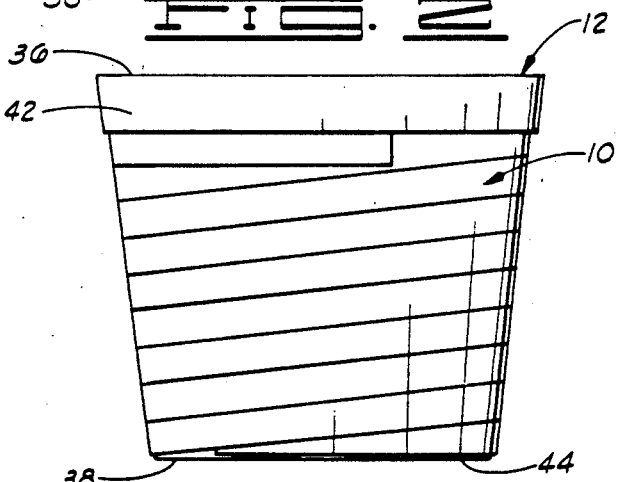
FIG. 3 is a side elevational view of the flower pot of FIG. 2 with the wrapping material wrapped generally about and extending over substantially all of the outer peripheral surface of the flower pot to provide a decorative covering therefore.

As shown in FIGS. 2 and 3, the flower pot 12 has an upper end 36, a lower end 38 and an outer peripheral surface 39. An object opening (not shown) intersects the upper end 36 of the flower pot 12 and extends a distance through the flower pot 12. The object opening (not shown) is sized and adapted to receive soil or the like for permitting a plant or flower to be planted and grown therein in a manner well know in the art.

The width 24 of the wrapping material is less than a height 40 of the flower pot 30. The height 40 of the flower pot 12 extends generally between the upper and the lower ends of the flower pot 12.

In use, the lower surface 18 of the wrapping material 10 generally near the first end 26 thereof is placed generally adjacent a portion of the outer peripheral surface 39 of the flower pot 12 and generally near the lower end 38 of the flower pot 12 so the first strip of adhesive 30 is disposed generally adjacent the outer peripheral surface 39 of the flower pot 12. The first end 26 of the strip of material 10 is pressed against the outer peripheral surface 39 of the flower pot 12 so the first strip of adhesive 30 adhesively connects the first end 26 of the wrapping material 10 to the outer peripheral surface 39 of the flower pot 12. As shown in FIG. 2, the first end of the wrapping material 10 has been adhesively connected to the flower pot 12 and the remaining portion of the wrapping material 10 is shown in a position wherein one has started to wrap the wrapping material 10 about the outer peripheral surface 39 of the flower pot 12.

The wrapping material 10 is wrapped about the circumference formed by the outer peripheral surface of the flower pot 12 in a series of wraps, as shown more clearly in FIG. 3. Each wrap is extended once about the outer peripheral surface 39 of the flower pot 12 while moving each wrap a distance generally upwardly toward the upper end 36 of the flower pot 12 until the wrapping material 10 covers a substantial portion of the outer peripheral surface 39 of the flower pot 10. Each wrap of the wrapping material 10 circumferentially about the outer peripheral surface 39 of the flower pot 12 overlaps a portion of the preceding wrap of the wrapping material 10 whereby the wrapping material 10 substantially covers the outer peripheral surface of the flower pot 10.

In the embodiment shown in FIG. 3, the flower pot 12 also includes a rim 42 and the wrapping material 10 is not extended about the rim 42 of the flower pot 12. If desired, the wrapping material 10 also can be extended about the rim 42. Further, in the embodiment shown in FIGS. 2 and 3, the flower pot 12 includes a bottom 44 and the wrapping material 10 is not extended about and does not cover the bottom 44 of the flower pot 12.

Figure 4:
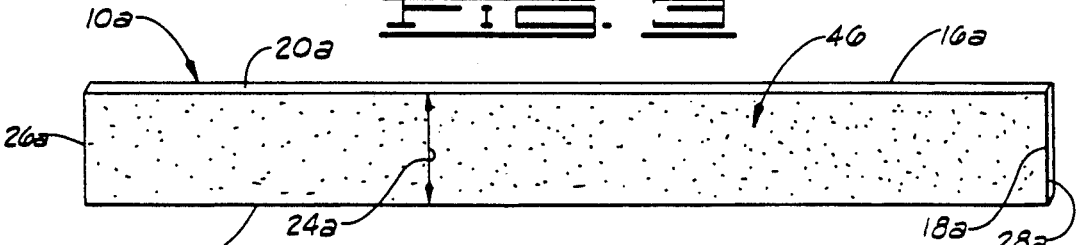
FIG. 4 is a partial perspective view of a modified wrapping material constructed in accordance with the present invention.

Shown in FIG. 4 is a modified wrapping material **10*a* which is constructed exactly like the wrapping material 10 shown in FIG. 1 and described in detail before, except the wrapping material 10*a* includes an adhesive 46 which extends substantially over the entire lower surface 18*a* of the wrapping material 10*a*. In this embodiment, the wrapping material 10*a* is adhesively connected to the outer peripheral surface 39 of the flower pot 12 generally over the entire length of the wrapping material 10*a*** which may be preferred in some applications.

Figure 5:
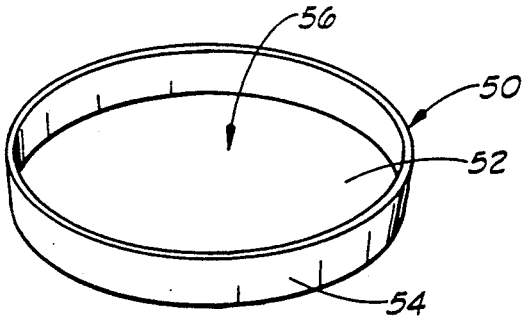
FIG. 5 is a partial perspective view of a cover bottom.

As mentioned before, when the wrapping material 10 or **10*a* is used to provide a decorative cover for the flower pot 12, the wrapping material 10 or 10***a* does not cover the bottom 44 of the flower pot 12. Shown in FIG. 5 is a cover bottom 50 which includes a generally circularly shaped base 52 and a rim 54. The rim 54 extends a distance upwardly from the base 52 and extends a distance circumferentially about the base 52. The rim 54 and the base 52 cooperate to form a pot receiving space 56 which is shaped and adapted to receive a portion of the flower pot 12 generally adjacent the lower end 38 thereof.

Figure 6:
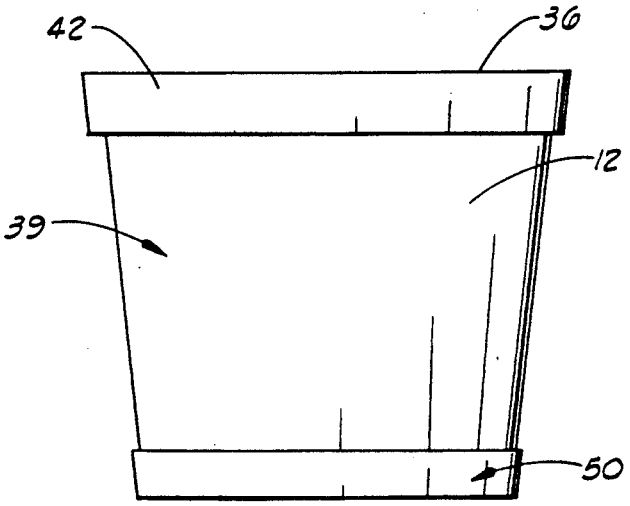
FIG. 6 is a side elevational view of a flower pot showing the cover bottom of FIG. 5 disposed on a lower end thereof.
Figure 7:
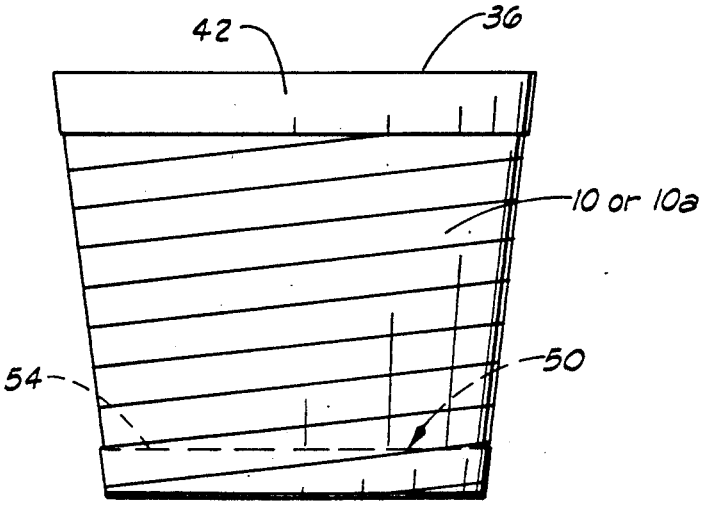
FIG. 7 is a side elevational view of the flower pot of FIG. 6 showing the cover bottom of FIGS. 5 and 6 connected thereto and showing the wrapping material of FIG. 1 or FIG. 4 wrapped about the outer peripheral surface of the flower pot and about a portion of the cover bottom to provide a decorative covering for the flower pot and to secure the cover bottom to the flower pot.

In use, the lower end 38 portion of the flower pot 12 is disposed in the pot receiving space 56 of the cover bottom 50 so that the cover bottom 50 is disposed generally over the bottom 44 of the flower pot 12 and the rim 54 extends over a portion of the outer peripheral surface 39 generally adjacent the lower end 38 of the flower pot 12, as shown in FIG. 6. After the cover bottom 50 has been placed on the lower end 38 of the flower pot 12, the wrapping material 10 or 10*a* then is wrapped about the outer peripheral surface 39 of the flower pot 12 in a manner like that described before in connection with FIGS. 1-3.

A portion of the wrapping material 10 or 10*a* extends over the rim 54 of the cover bottom 50 and the wrapping material 10 or 10*a* cooperates to secure the cover bottom 50 to the flower pot 12.

Figure 8:
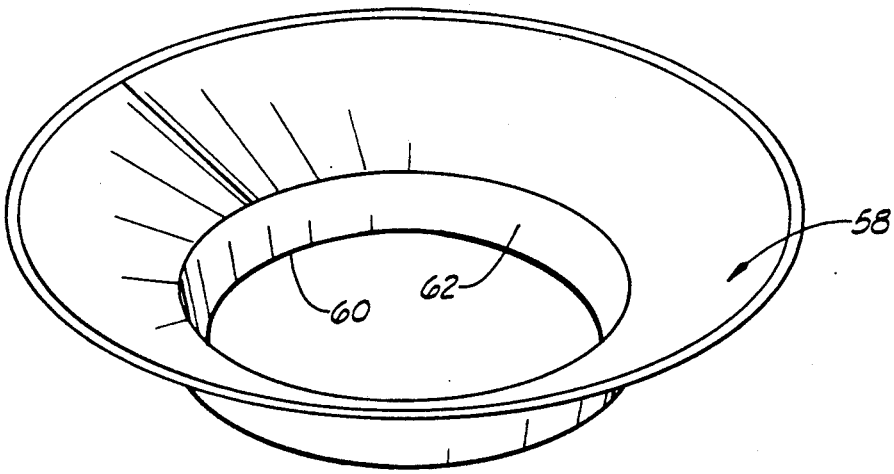
FIG. 8 is a partial perspective view of a skirt.
Figure 9:
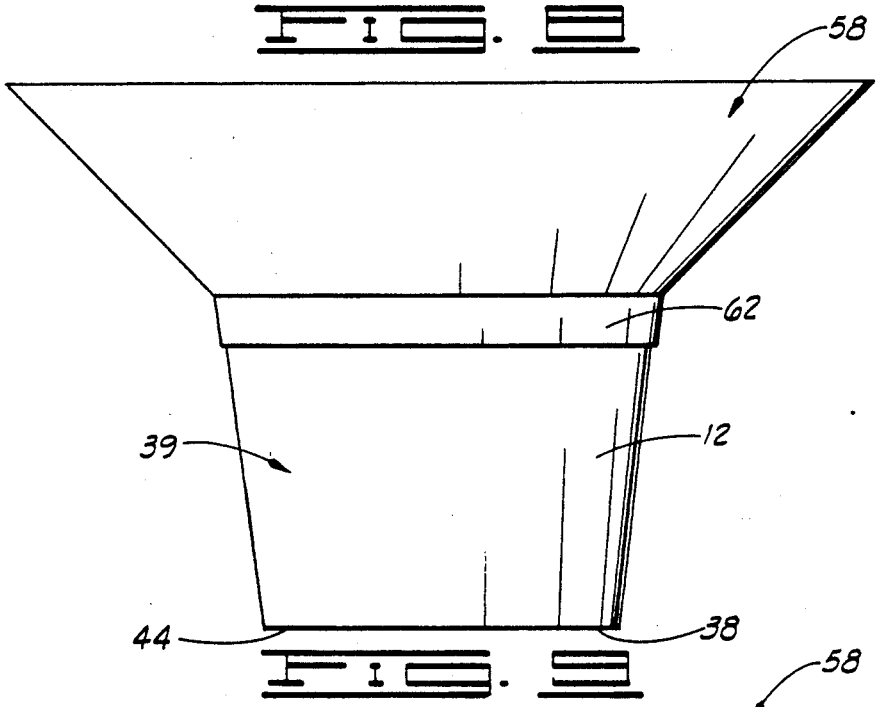
FIG. 9 is a side elevational view of a flower pot showing the skirt of FIG. 8 disposed on an upper end portion thereof.
Figure 10:
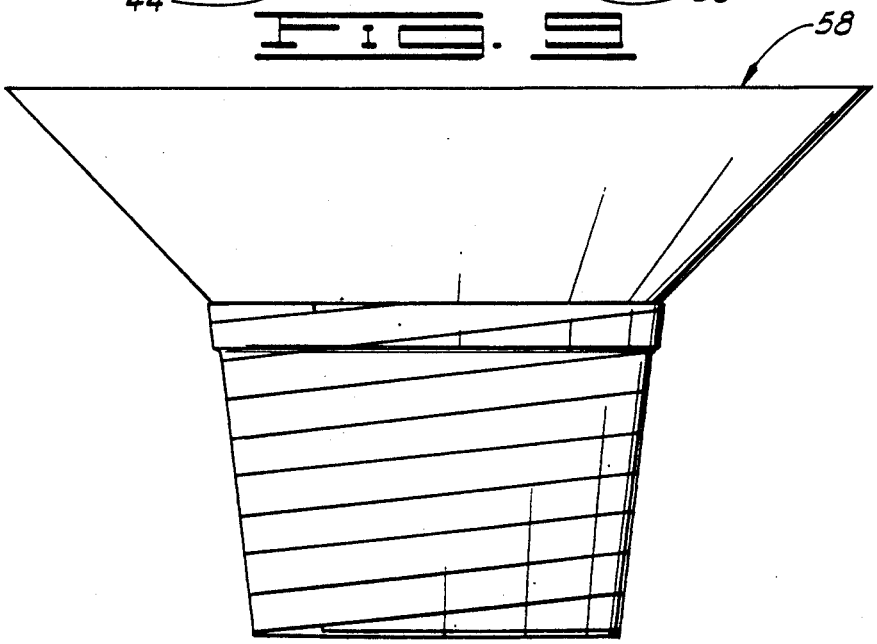
FIG. 10 is a side elevational view of the flower pot of FIG. 9 showing the skirt of FIGS. 8 and 9 disposed on the upper end portion thereof and showing the wrapping material of FIGS. 1 or 4 wrapped about the outer peripheral surface of the flower pot and about a portion of the skirt for securing the skirt to the flower pot and for providing a decorative covering for the flower pot.

As mentioned before, the wrapping material 10 or 10*a* does not provide a decorative skirt extending from the upper end 36 of the flower pot 12 which may be desired in some applications. Shown in FIGS. 8, 9 and 10 is a cover skirt 58. The cover skirt 58 has a generally circularly shaped opening 60 formed through a central portion thereof and the cover skirt 58 extends generally outwardly and upwardly from the opening 60. A skirt rim 62 is formed on the cover skirt 58 and the skirt rim 62 extends circumferentially about the opening 60. The skirt rim 62 extends a distance generally downwardly from the opening 60 and the cover skirt 58.

In use, the cover skirt 58 is disposed generally above the flower pot 12 and positioned over the flower pot 12 in a position wherein the upper end 36 portion of the flower pot 12 extends through the opening 60 and the cover skirt 58. In this position of the cover skirt 58, the skirt rim 62 extends circumferentially about and over a portion of the outer peripheral surface 39 generally near the upper end 36 of the flower pot 12. After positioning the cover skirt 58 in this position, the wrapping material 10 or 10*a* then is wrapped about the outer peripheral surface 39 of the flower pot 12 in the manner described before in connection with FIGS. 1-7. A portion of the wrapping material 10 or 10*a* extends over the skirt rim 62 and the wrapping material 10 or 10*a* thus cooperates to secure the cover skirt 58 to the flower pot 12. In the assembled position, the cover skirt 58 extends outwardly and upwardly from the upper end 36 of the flower pot 12 to provide a decorative skirt portion.

Although the cover skirt 58 is shown in FIGS. 8, 9 and 10 to have a generally circularly shaped upper, the skirt could be formed with various shapes such a scalloped edges or a four corned skirt also could be formed. In this embodiment, the user has the option of using various skirts of different shapes and having different colors or patterns formed thereon together with various colors or patterns formed on different wrapping materials 10 or 10*a* to provide various different aesthetic affects. It also should be noted that the cover skirt 58 and the cover bottom 50 both could be used along with the wrapping material 10 or 10*a* to form the decorative covering in accordance with present invention.

Figure 11:
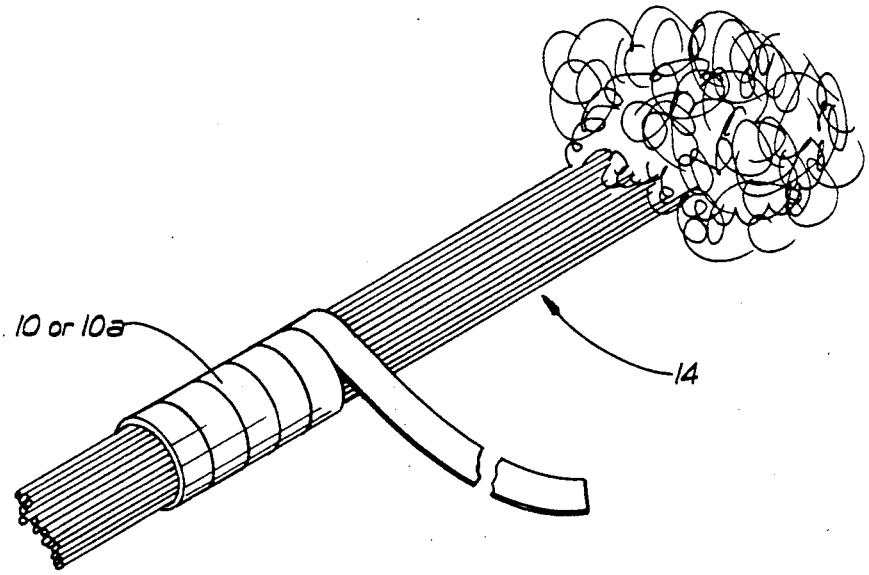
FIG. 11 is a partial perspective view showing a floral grouping and showing the wrapping material of FIGS. 1 or 4 wrapped about a portion of the outer peripheral surface of the floral grouping for providing a decorative covering for the floral grouping.

Shown in FIG. 11 is the floral grouping 14 having an upper end with the flower blooms and a lower end. The upper end more particularly is the flower or bloom end of the flower grouping 14.

In this embodiment, the wrapping material 10 or 10*a* is wrapped about the floral grouping 14 generally adjacent the lower end thereof and extending a distance toward the upper end thereof to provide a decorative covering and to secure the floral grouping in an assembled or connected positioned. The wrapping material 10 or 10*a* is wrapped about the outer peripheral surface of the floral grouping 14 in the manner like that described before with respect to the flower pot 12.

Figure 12:
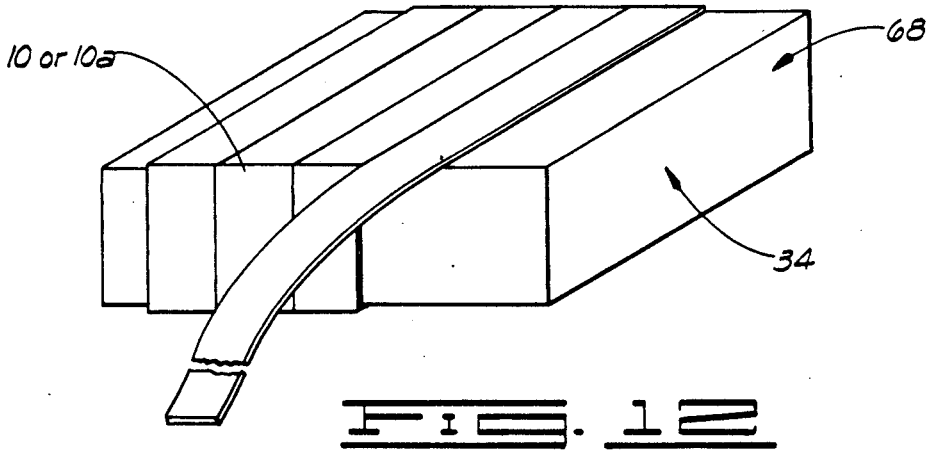
FIG. 12 is a partial perspective view of a item such as a box containing a gift or the gift itself and showing the wrapping material of FIGS. 1 or 4 wrapped about a portion 1 of the outer peripheral surface of the item for providing the decorative covering for the item.

Shown in FIG. 12 is the package 34 having an outer peripheral surface 68. In this embodiment, the wrapping material 10 or 10*a* is wrapped about the outer peripheral surface 68 of the package 34 to cover a substantial portion of the outer peripheral surface 68 and provide a decorative covering for the package 34. The wrapping material 10 or 10*a* is wrapped about the outer peripheral surface 68 in a manner like that described before with respect to the flower pot 12.

Figure 13:
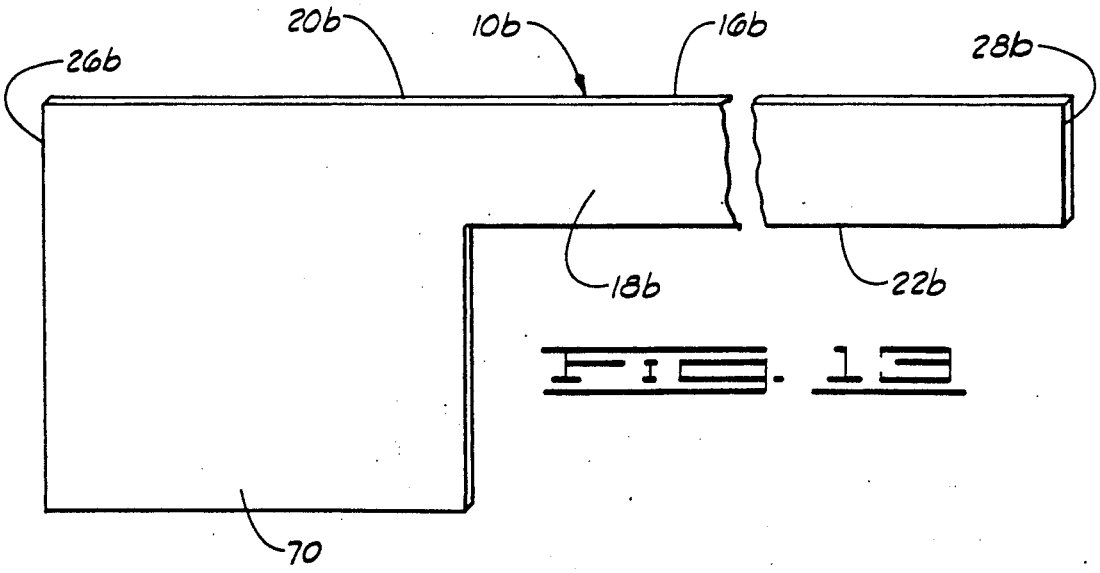
FIG. 13 is a partial perspective view of a modified wrapping material having a bottom extension connected to one end thereof for forming the bottom portion of the covering when the wrapping material is used to provide a decorative covering for a flower pot for example.

Shown in FIG. 13 is a modified wrapping material 10*b* which is constructed exactly like the wrapping material 10*a* except the wrapping material 10*b* includes a bottom extension 70 formed on the second side 22*b* of the wrapping material 10*b*. The extension extends a distance outwardly from the second side 22*b* generally near the first end 26*b* and extending a distance generally toward the second end 28*b*.

Figure 15:
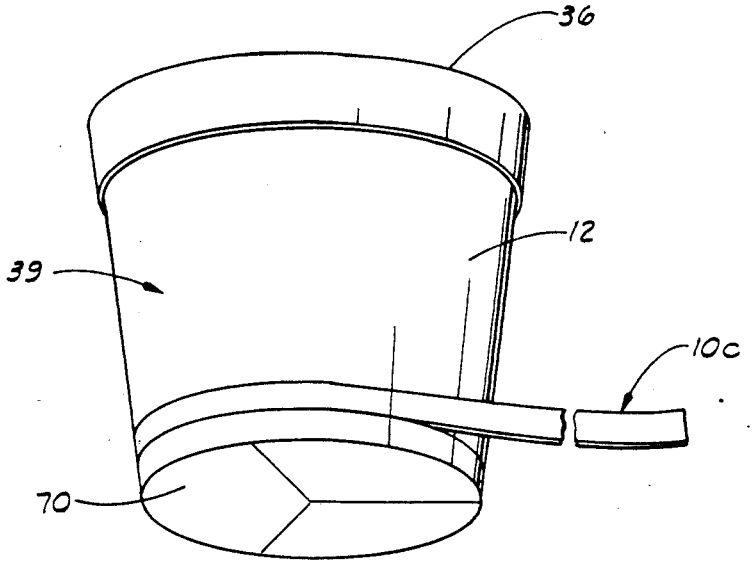
FIG. 15 is a side elevational view showing a flower pot having the wrapping material of FIGS. 14 or 13 wrapped thereabout.

In use, the bottom extension initially is disposed over the bottom 44 of the flower pot 12 and the remaining portion of the wrapping material 10*b* is then wrapped about the outer peripheral surface 39 of the flower pot 12 in a manner like that described before with respect to the wrapping materials 10*a* or 10*b* and the flower pot 12 shown in FIGS. 2, 3, 6, 7, 9 and 10. When the bottom extension 70 is disposed over the bottom 44 of the flower pot 12, a portion of the bottom extension 70 extends over a portion of the outer peripheral surface 39 of the flower pot 12 generally near the lower end 38 thereof and a portion of the wrapping material 10*b* then is wrapped about the portion of the bottom extension 70 which extends over a portion of the outer peripheral surface 39 to secure the bottom extensions 70 in an assembled position secured over the bottom 44 of the flower pot 12, as shown in FIG. 15.

Figure 14:
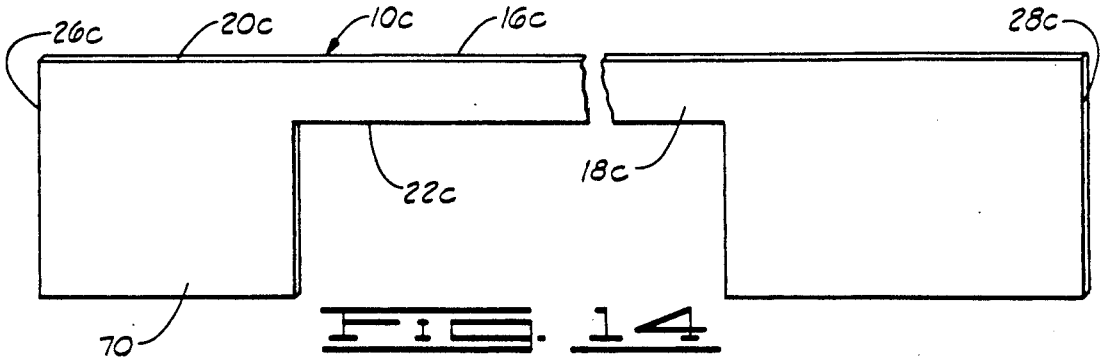
FIG. 14 is a partial perspective view of another modified wrapping material having a bottom extension formed on one end thereof similar to the wrapping material shown in FIG. 13 and having a skirt extension formed on the opposite end, the skirt extension being adapted to form the skirt of the decorative covering when the wrapping material of FIG. 14 is used to provide a decorative covering for a flower pot.

Shown in FIG. 14 is another modified wrapping material 10*c* which is constructed exactly like the wrapping material 10*b* shown in FIG. 13, except the wrapping material 10*c* also includes a skirt extension 74. The skirt extension 74 is formed on the second side 22*c* of the wrapping material 10*c* and extends a distance outwardly from the second side 22*c*. The skirt extension 74 extends generally from the second end 28*c* of the wrapping material 10*c* a distance generally toward the first end 26*c*.

Figure 16:
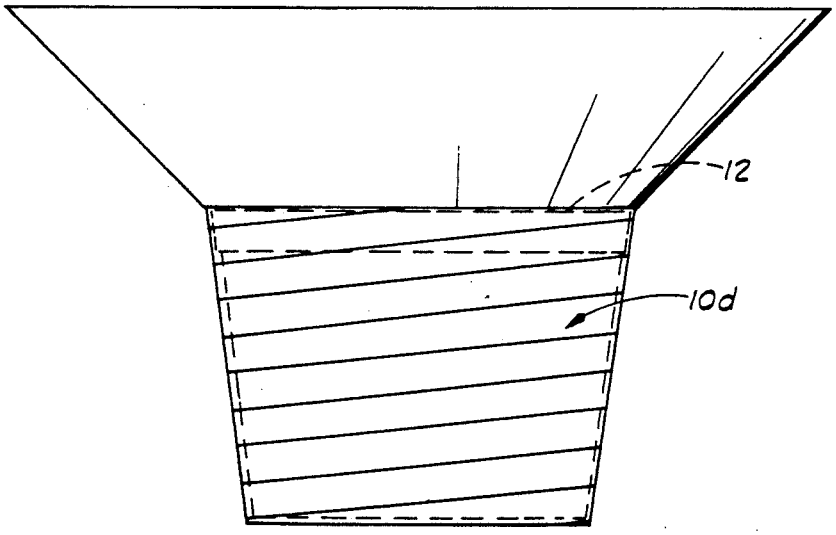
FIG. 16 is a side elevational view of a flower pot showing the wrapping material of FIG. 14 wrapped about a portion thereof.

In use, the bottom extension 70 is disposed about and secured generally to the bottom 44 of the flower pot 12 in a manner described before in connection with FIGS. 13 and 15 and the wrapping material 10*c* is then wrapped about the outer peripheral surface 39 of the flower pot 12. As the wrapping material 10*c* is wrapped about the outer peripheral surface 39 of the flower pot 12, the last wrap wraps the skirt extension 74 generally about the upper end 36 of the flower pot 12. In this connected position, as shown in FIG. 16, the skirt extension 16 extends generally circumferentially about the upper end 36 of the flower pot 12 and extends generally upwardly and outwardly from the upper end 36 of the flower pot 12.

Changes may be made in the construction of the various components, parts, elements or materials of the various wrapping materials described herein and changes may be made in the steps or the sequence of steps of the methods described herein without departing from the spirit and scope of the invention as defined in the following claims.

What is claimed is:

1. An apparatus for providing a decorative cover for a flower pot having an upper end and a lower end and a bottom and a height extending generally between the upper and the lower ends of the flower pot and an outer peripheral surface extending generally between the upper and the lower ends of the flower pot, comprising:

a length of wrapping material having a first side, a second side and at least a first end and an upper surface and a lower surface, the first end of the wrapping material being positionable generally on the outer peripheral surface of the item to be wrapped and the wrapping material being wrappable about the outer peripheral surface of the item to be wrapped in at least one of a series of wraps with each wrap extending once about the outer peripheral surface of the item to be wrapped until the wrapping material covers at least a portion of the outer peripheral surface of the item to be wrapped whereby the wrapping material provides a decorative covering for the item; and a bottom extension formed on the second side of the wrapping material and being disposed generally near the first end of the wrapping material, the bottom extension extending a distance from the first end of the material generally toward the second end of the material, the bottom extension being adapted to be formed about the bottom of the flower pot cover prior to wrapping the wrapping material about the outer peripheral surface of the flower pot.

2. The apparatus of claim 1 wherein the bottom extension further comprises a portion which extends about a portion of the outer peripheral surface of the flower pot near the lower end of the flower pot whereby a portion of the wrapping material is wrapped about the portion of the bottom extension extending about the outer peripheral surface of the flower pot for securing the bottom extension in position disposed over the bottom of the flower pot.

3. The apparatus of claim 1 wherein the wrapping material includes a second end and wherein the wrapping material further comprises:

a skirt extension formed on the second side of the wrapping material and extending a distance therefrom, the skirt extension being disposed near the second end of the wrapping material and extending a distance from the second end toward the first end of the wrapping material, the skirt extension forming a decorative skirt extending generally outwardly from the upper end of the flower pot when the wrapping material is wrapped about the outer peripheral surface of the flower pot.

4. An apparatus for providing a decorative covering, comprising:

a flower pot having an upper end and a lower end and a bottom and a height extending generally between the upper and the lower ends of the flower pot and an outer peripheral surface extending generally between the upper and the lower ends of the flower pot;

a length of wrapping material having a first side, a second side and at least a first end and an upper surface and a lower surface, the first end of the wrapping material being positioned on the outer peripheral surface of the flower pot and the wrapping material being wrapped about the outer peripheral surface of the flower pot in a plurality of wraps with each wrap extending once about the outer peripheral surface of the flower pot until the wrapping material covers substantially the entire the outer peripheral surface of the flower pot whereby the wrapping material provides the decorative covering for the flower pot;

a cover bottom adapted to be connected to the bottom of the flower pot for cooperating with the wrapping material to provide the decorative covering for the flower pot, the cover bottom comprising a base and a rim extending about the outer peripheral surface of the base and extending a distance generally upwardly therefrom cooperating with the base to form a pot receiving space, the bottom of the flower pot being disposable generally within the pot receiving space and the rim extending a distance over a portion of the outer peripheral surface of the flower pot near the lower end of the flower pot, a portion of the wrapping material being wrapped about the rim of the cover bottom to secure the cover bottom to the flower pot.

5. An apparatus for providing a decorative covering, comprising:

a flower pot having an upper end and a lower end and a bottom and height extending generally between the upper and the lower ends of the flower pot and an outer peripheral surface extending generally between the upper and the lower ends of the flower pot;

a length of wrapping material having a first side, a second side and at least a first end and an upper surface and a lower surface, the first end of the wrapping material being positioned generally on the outer peripheral surface of the flower pot and the wrapping material being wrapped about the outer peripheral surface of the flower pot in a plurality of wraps with each wrap extending once about the outer peripheral surface of the flower pot until the wrapping material covers substantially the entire outer peripheral surface of the flower pot whereby the wrapping material provides a decorative covering for the flower pot, the wrapping material having adhesive on the lower surface for adhesively connecting the wrapping material to the flower pot;

a cover skirt disposed on the upper end of the flower pot for providing a decorative skirt extending generally outwardly from the upper end of the flower pot for cooperating with the wrapping material to provide the decorative covering for the flower pot, the cover skirt including an opening formed through a portion thereof and the upper end of the flower pot extending through the opening in the cover skirt, the cover skirt including a skirt rim extending about the opening in the skirt and extending a distance from the skirt, the skirt rim being disposed over a portion of the outer peripheral surface of the flower pot near the upper end of the flower pot and a portion of the wrapping material being wrapped about a portion of the rim for securing the rim to the flower pot.

* * * * *